US008028437B2

(12) United States Patent
Brown-Carter

(10) Patent No.: US 8,028,437 B2
(45) Date of Patent: Oct. 4, 2011

(54) HAIR DRYER AND VACUUM DEVICE

(76) Inventor: Pauline Brown-Carter, Wellington, FL (US)

( * ) Notice: Subject to any disclaimer, the term of this patent is extended or adjusted under 35 U.S.C. 154(b) by 513 days.

(21) Appl. No.: 12/244,483

(22) Filed: Oct. 2, 2008

(65) Prior Publication Data

US 2009/0106998 A1 Apr. 30, 2009

Related U.S. Application Data

(63) Continuation-in-part of application No. 11/346,433, filed on Dec. 19, 2006, now abandoned.

(51) Int. Cl.
*F26B 11/02* (2006.01)

(52) U.S. Cl. ..... 34/96; 34/97; 34/98; 34/100; 219/233; 132/232; 132/119.1; 705/14; 392/384; 392/385; 428/4; 606/15; 606/91

(58) Field of Classification Search ..... 34/96, 97, 34/99, 100; 132/232, 119.1; 428/4; 392/384, 392/385; 606/15, 91; 705/14; 219/233
See application file for complete search history.

(56) References Cited

U.S. PATENT DOCUMENTS

| | | | | | |
|---|---|---|---|---|---|
| 918,929 | A * | 4/1909 | Thurman | 15/399 |
| 1,308,685 | A * | 7/1919 | DiSalvio | 15/330 |
| 2,066,847 | A * | 1/1937 | McShea | 34/80 |
| 2,232,218 | A * | 2/1941 | Doty | 15/367 |
| 2,270,008 | A * | 1/1942 | Miller | 34/100 |
| 2,314,101 | A * | 3/1943 | Phipps | 34/77 |
| 2,527,745 | A * | 10/1950 | Lawrence | 34/77 |
| 2,827,276 | A * | 3/1958 | Racheter | 432/62 |
| 3,224,454 | A * | 12/1965 | Quinio et al. | 132/232 |
| 3,430,353 | A * | 3/1969 | Selinger | 34/100 |
| 3,529,310 | A * | 9/1970 | Olmo | 5/423 |
| 3,765,975 | A * | 10/1973 | Hollingsworth | 156/94 |
| 3,903,904 | A * | 9/1975 | Hemrich et al. | 132/118 |
| 3,903,905 | A * | 9/1975 | Tucker | 132/118 |
| 4,131,121 | A * | 12/1978 | Araki et al. | 132/211 |
| 4,210,162 | A * | 7/1980 | Dreyer et al. | 132/271 |
| 4,314,405 | A * | 2/1982 | Park | 30/133 |
| 4,381,716 | A * | 5/1983 | Hastings et al. | 109/2 |
| 4,523,528 | A * | 6/1985 | Hastings et al. | 109/42 |
| 4,536,198 | A * | 8/1985 | Strain | 95/125 |
| 4,629,863 | A * | 12/1986 | Giordano | 392/383 |
| 4,662,288 | A * | 5/1987 | Hastings et al. | 109/2 |

(Continued)

FOREIGN PATENT DOCUMENTS

EP 318133 A1 * 5/1989

(Continued)

*Primary Examiner* — Stephen M. Gravini
(74) *Attorney, Agent, or Firm* — Dale J. Ream

(57) ABSTRACT

A hair dryer and vacuum device includes a housing having a nozzle, a handle, and a body portion situated between the handle and nozzle, the nozzle including a first channel extending from the body portion to an outlet port and a second channel extending from the body portion to an inlet port. A heating coil is mounted in the body portion for heating air and a dryer fan is positioned adjacent the heating coil that is configured to blow the heated air through the outlet port when energized. A vacuum fan is mounted in the second channel and configured to draw air into the second channel through the inlet port when energized. The device includes a collection chamber situated between the vacuum fan and the body portion and in communication with the second channel such that fallen hair is collected therein.

13 Claims, 7 Drawing Sheets

U.S. PATENT DOCUMENTS 4,671,298 A * 6/1987 Babb et al. ..... 600/532
4,721,121 A * 1/1988 Adams ..... 132/212
4,748,915 A * 6/1988 Hastings et al. ..... 109/2
4,766,420 A * 8/1988 Hastings et al. ..... 340/550
5,088,441 A * 2/1992 Bell ..... 118/67
5,121,463 A * 6/1992 Yoshihara ..... 392/379
5,265,348 A * 11/1993 Fleishman et al. ..... 34/97
5,275,183 A * 1/1994 Landry ..... 132/271
5,297,942 A * 3/1994 Fleishman et al. ..... 417/354
5,327,919 A * 7/1994 Hanlon ..... 132/270
5,444,215 A * 8/1995 Bauer ..... 219/222
5,500,237 A * 3/1996 Gell et al. ..... 426/466
5,646,115 A * 7/1997 Frank et al. ..... 424/185.1
5,795,862 A * 8/1998 Frank et al. ..... 514/18.7
5,840,695 A * 11/1998 Frank et al. ..... 514/18.7
5,845,604 A * 12/1998 Cucchi et al. ..... 119/673
5,924,215 A * 7/1999 Goodsell ..... 34/98
5,927,230 A * 7/1999 Frank et al. ..... 119/6.5
5,932,470 A * 8/1999 Frank et al. ..... 435/252.3
5,934,362 A * 8/1999 Barker, II ..... 165/48.1
6,030,464 A * 2/2000 Azevedo ..... 134/6
6,106,853 A * 8/2000 Cox et al. ..... 424/405
6,280,784 B1 * 8/2001 Yang et al. ..... 426/231
6,287,191 B1 * 9/2001 Barker, II ..... 454/248
6,296,459 B1 * 10/2001 Saputo et al. ..... 417/423.14
6,379,149 B1 * 4/2002 Franetzki ..... 433/77
6,579,060 B1 * 6/2003 Mann et al. ..... 415/119
6,615,506 B2 * 9/2003 Miller ..... 34/97
6,925,728 B2 * 8/2005 Busa et al. ..... 34/96
7,041,377 B2 * 5/2006 Miura et al. ..... 428/442
7,055,763 B2 * 6/2006 Torigoe ..... 239/135
7,096,598 B1 * 8/2006 Myatt ..... 34/96
7,155,924 B2 * 1/2007 Zuckerman et al. ..... 62/424
7,160,949 B2 * 1/2007 Ota et al. ..... 525/242
7,163,571 B2 * 1/2007 Ruan ..... 95/226
7,166,693 B2 * 1/2007 Frank et al. ..... 530/324
7,270,959 B2 * 9/2007 Hudak ..... 435/7.1
7,300,633 B2 * 11/2007 Hudak et al. ..... 422/537
7,423,002 B2 * 9/2008 Shah et al. ..... 510/278
7,481,006 B2 * 1/2009 Donovan ..... 34/218
7,556,841 B2 * 7/2009 Kimball et al. ..... 427/292
7,591,043 B2 * 9/2009 Ninomiya et al. ..... 15/339
7,621,991 B2 * 11/2009 Ruan ..... 96/262
7,629,446 B2 * 12/2009 Hunter et al. ..... 536/23.1
7,727,289 B2 * 6/2010 Frazee et al. ..... 8/550
7,763,083 B2 * 7/2010 Kimball et al. ..... 8/550
7,776,108 B2 * 8/2010 Shah et al. ..... 8/550
7,780,744 B2 * 8/2010 Shah et al. ..... 8/550
7,789,902 B2 * 9/2010 Clayton et al. ..... 607/107
7,829,146 B2 * 11/2010 Shah et al. ..... 427/292
7,876,917 B2 * 1/2011 Shim ..... 381/189
7,947,640 B2 * 5/2011 Shah et al. ..... 510/278
2002/0169104 A1 * 11/2002 Frank et al. ..... 514/2
2003/0055179 A1 * 3/2003 Ota et al. ..... 525/242
2003/0109621 A1 * 6/2003 Miura et al. ..... 524/464
2003/0185755 A1 * 10/2003 Frank et al. ..... 424/9.2
2003/0221118 A1 * 11/2003 Walker ..... 713/193
2004/0260209 A1 * 12/2004 Ella et al. ..... 601/7
2004/0260210 A1 * 12/2004 Ella et al. ..... 601/7
2004/0260470 A1 * 12/2004 Rast ..... 701/300
2005/0000054 A1 * 1/2005 Ninomiya et al. ..... 15/347
2005/0121540 A1 * 6/2005 Torigoe ..... 239/289
2005/0172658 A1 * 8/2005 Zuckerman et al. ..... 62/424
2005/0284292 A1 * 12/2005 Ruan ..... 95/226
2006/0039986 A1 * 2/2006 Okamoto et al. ..... 424/489
2006/0130393 A1 * 6/2006 Clayton et al. ..... 43/132.1
2006/0137313 A1 * 6/2006 Simon et al. ..... 55/400
2006/0276367 A1 * 12/2006 Shah et al. ..... 510/356
2006/0287783 A1 * 12/2006 Walker ..... 701/29
2006/0288499 A1 * 12/2006 Kimball et al. ..... 8/550
2007/0014921 A1 * 1/2007 Kimball et al. ..... 427/258
2007/0027411 A1 * 2/2007 Ella et al. ..... 601/7
2007/0051008 A1 * 3/2007 Donovan ..... 34/96
2007/0053842 A1 * 3/2007 Okpala ..... 424/46
2007/0089621 A1 * 4/2007 Kimball et al. ..... 101/127
2007/0154920 A1 * 7/2007 Frank et al. ..... 435/6
2007/0155863 A1 * 7/2007 Mohanty et al. ..... 524/9
2007/0245722 A1 * 10/2007 Ruan ..... 60/298
2007/0277848 A1 * 12/2007 Shah et al. ..... 134/4
2007/0277849 A1 * 12/2007 Shah et al. ..... 134/4
2008/0085021 A1 * 4/2008 Shim ..... 381/189
2008/0131830 A1 * 6/2008 Nix ..... 432/220
2008/0253754 A1 * 10/2008 Rubin ..... 392/381
2008/0307587 A1 * 12/2008 Shah et al. ..... 8/441
2009/0019647 A1 * 1/2009 Frazee et al. ..... 8/553
2009/0032126 A1 * 2/2009 Kissel, Jr. ..... 137/565.23
2009/0093361 A1 * 4/2009 Sakatani et al. ..... 502/309
2009/0106998 A1 * 4/2009 Brown-Carter ..... 34/90
2009/0117258 A1 * 5/2009 Shah et al. ..... 427/8
2009/0211052 A1 * 8/2009 Ninomiya et al. ..... 15/339
2009/0229967 A1 * 9/2009 Sakatani ..... 204/157.3
2009/0271933 A1 * 11/2009 Shah et al. ..... 8/562
2010/0154146 A1 * 6/2010 Shah et al. ..... 8/552
2010/0210745 A1 * 8/2010 McDaniel et al. ..... 521/55
2010/0252194 A1 * 10/2010 Kimball et al. ..... 156/305
2010/0256263 A1 * 10/2010 Shah et al. ..... 524/35
2010/0331931 A1 * 12/2010 Clayton et al. ..... 607/104
2011/0038826 A1 * 2/2011 Kimball et al. ..... 424/76.1
2011/0056509 A1 * 3/2011 Benest et al. ..... 132/223
2011/0073786 A1 * 3/2011 Shim ..... 250/505.1
2011/0097506 A1 * 4/2011 Shah et al. ..... 427/458
2011/0103604 A1 * 5/2011 Shim ..... 381/71.1
2011/0103623 A1 * 5/2011 Shim ..... 381/189

FOREIGN PATENT DOCUMENTS

EP 459528 A2 * 12/1991
JP 01230957 A * 9/1989
JP 02233941 A * 9/1990
JP 03254708 A * 11/1991
WO WO 9214380 A1 * 9/1992
WO WO 02063990 A1 * 8/2002

* cited by examiner

HAIR DRYER AND VACUUM DEVICE

CROSS REFERENCE TO RELATED APPLICATIONS

This application is a continuation-in-part application that claims the benefit of U.S. application Ser. No. 11/346,433 filed Dec. 19, 2006 now abandoned and titled Penny's Portable Compact Hair Dry/Vacuum.

BACKGROUND OF THE INVENTION

This invention relates generally to a hair care accessory and, more particularly, to a hair dryer having a vacuum suction assembly for selectively collecting fallen hair.

Hot air blowing devices are commonly used by beauticians and barbers in the process of cutting and styling a person's hair. A natural consequence and inconvenience following the cutting of hair is collecting it for disposal. Picking up fallen hair typically requires the use of a broom and dust pan and then stooping over to pick up the dust pan to dump it in a trash receptacle. Unfortunately, the act of repetitively stooping to pick up collected hair may be painful back soreness and frustration.

Therefore, it would be desirable to have a hair dryer and vacuum device for selectively blowing wet hair dry or vacuuming fallen hair. Further, it would be desirable to have a hair dryer and vacuum device that can blow hot air through one channel of a nozzle or suction air through another channel of the nozzle.

SUMMARY OF THE INVENTION

A hair dryer and vacuum device according to the present invention includes a housing having a nozzle, a handle, and a body portion situated between the handle and the nozzle, the nozzle including a first channel extending from the body portion to an outlet port and a second channel extending from the body portion to an inlet port. A heating coil is mounted in the body portion for heating air and a dryer fan is positioned adjacent to the heating coil that is configured to blow the heated air from the body portion through the first channel outlet port when energized. A vacuum fan is mounted in the second channel that is configured to draw air into the second channel through the second channel inlet port when energized. The device includes a collection chamber situated between the vacuum fan and the body portion and in communication with the second channel such that fallen hair is collected therein.

Objects and advantages of the present invention will become apparent from the following description taken in connection with the accompanying drawings, wherein is set forth by way of illustration and example, embodiments of this invention.

DESCRIPTION OF THE PREFERRED EMBODIMENT

A hair dryer and vacuum device according to a preferred embodiment of the present invention will now be described with reference to FIGS. 1*a* to 7 of the accompanying drawings.

Figure 1A:
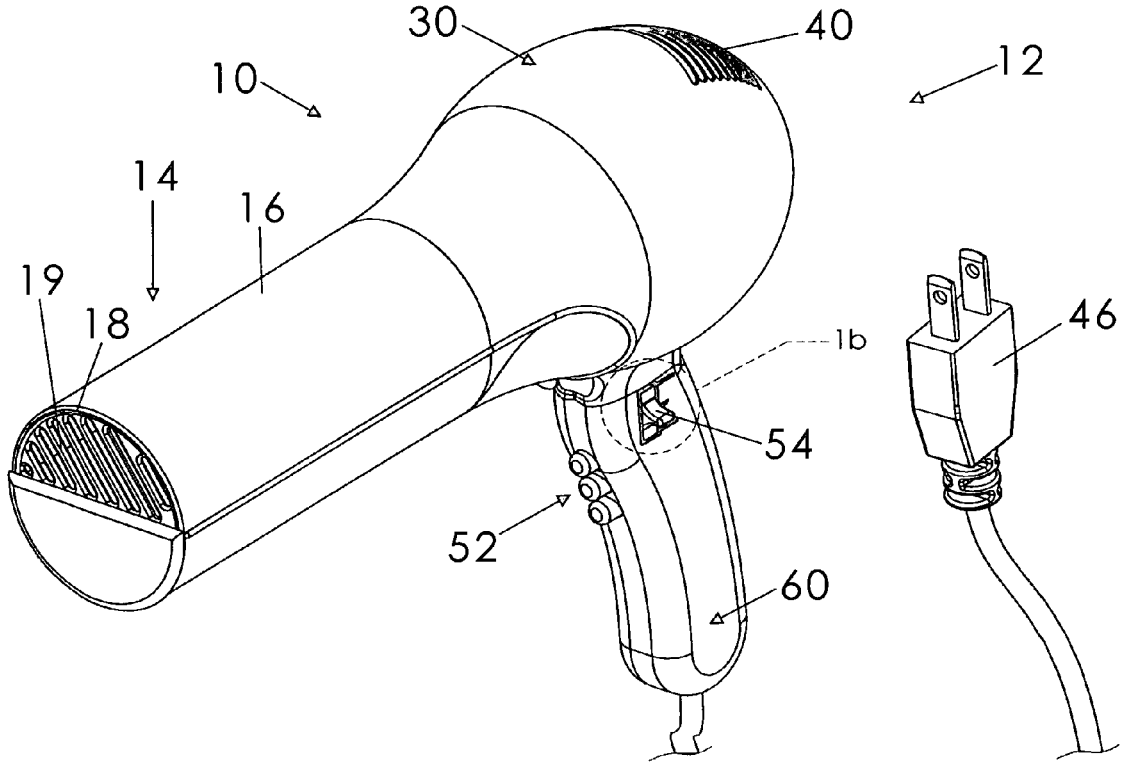
FIG. 1*a* is a perspective view of a hair dryer and vacuum device according to a preferred embodiment of the present invention.
Figure 1B:
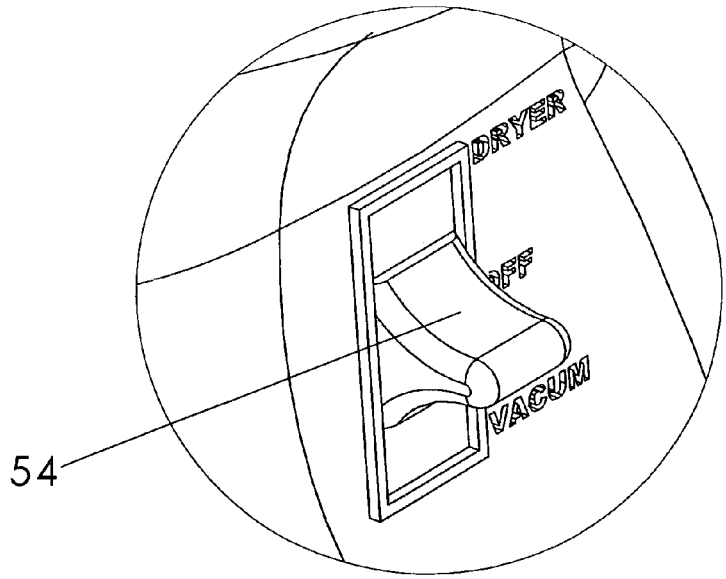
FIG. 1*b* is an isolated view on an enlarged scale taken from a portion of FIG. 1*a;*

More particularly, the hair dryer and vacuum device 10 includes a housing 12 having a nozzle 14, a handle 60, and a body portion 30 situated between the handle 60 and nozzle 14 (FIG. 1*a*). The device 10 presents an overall configuration that is similar to that of a traditional blow dryer but with several unique structures and functions as will be further described below. It is understood that the nozzle 14 and body portion 30 define generally hollow interior areas.

Figure 2A:
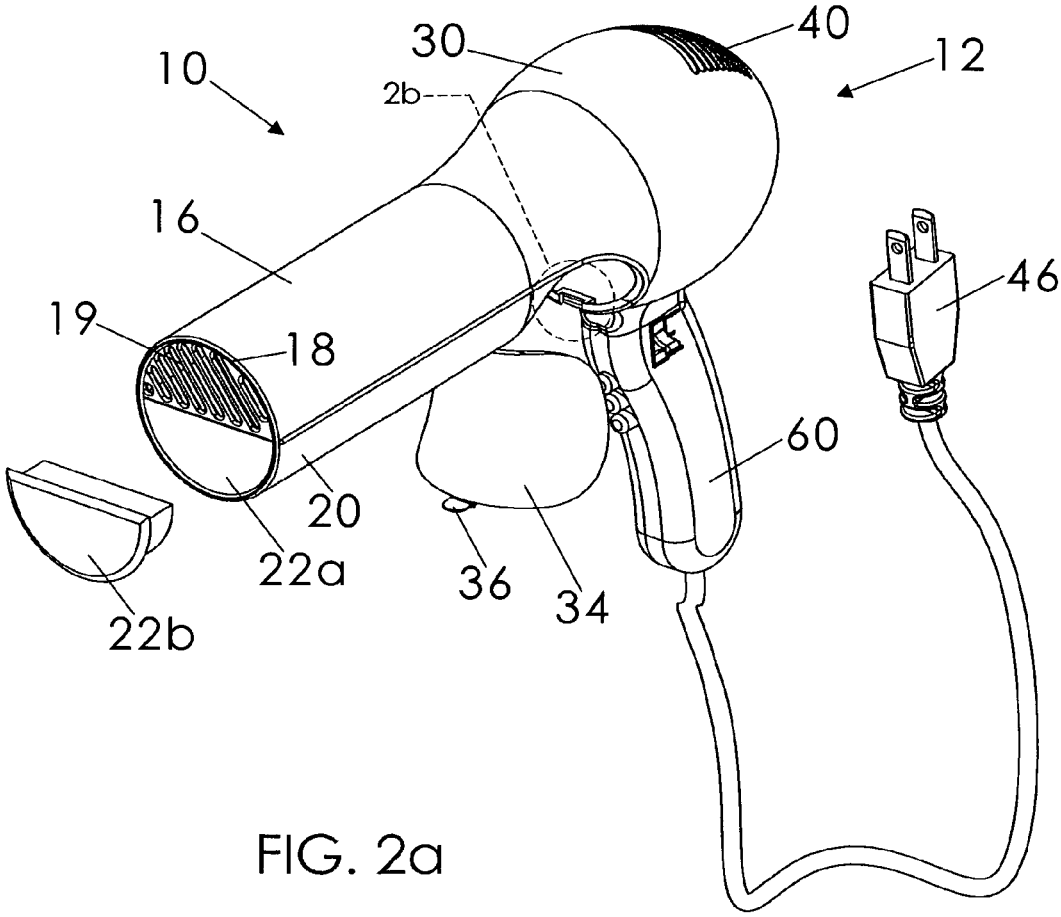
FIG. 2*a* is an exploded view of the device as in FIG. 1*a;*
Figure 2B:
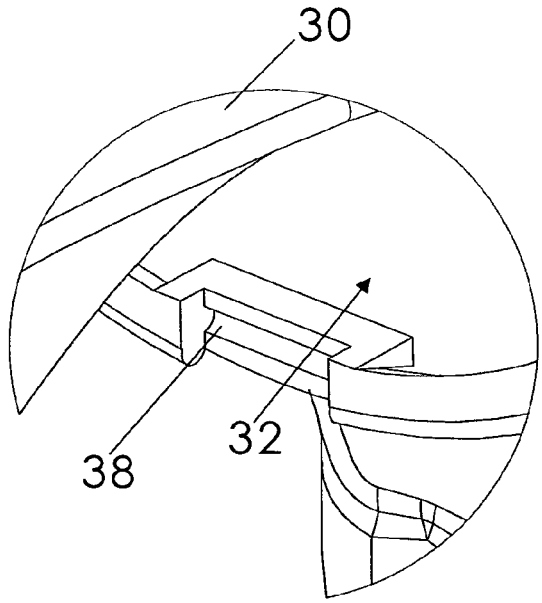
FIG. 2*b* is an isolated view on an enlarged scale taken from a portion of FIG. 2*a;*
Figure 3:
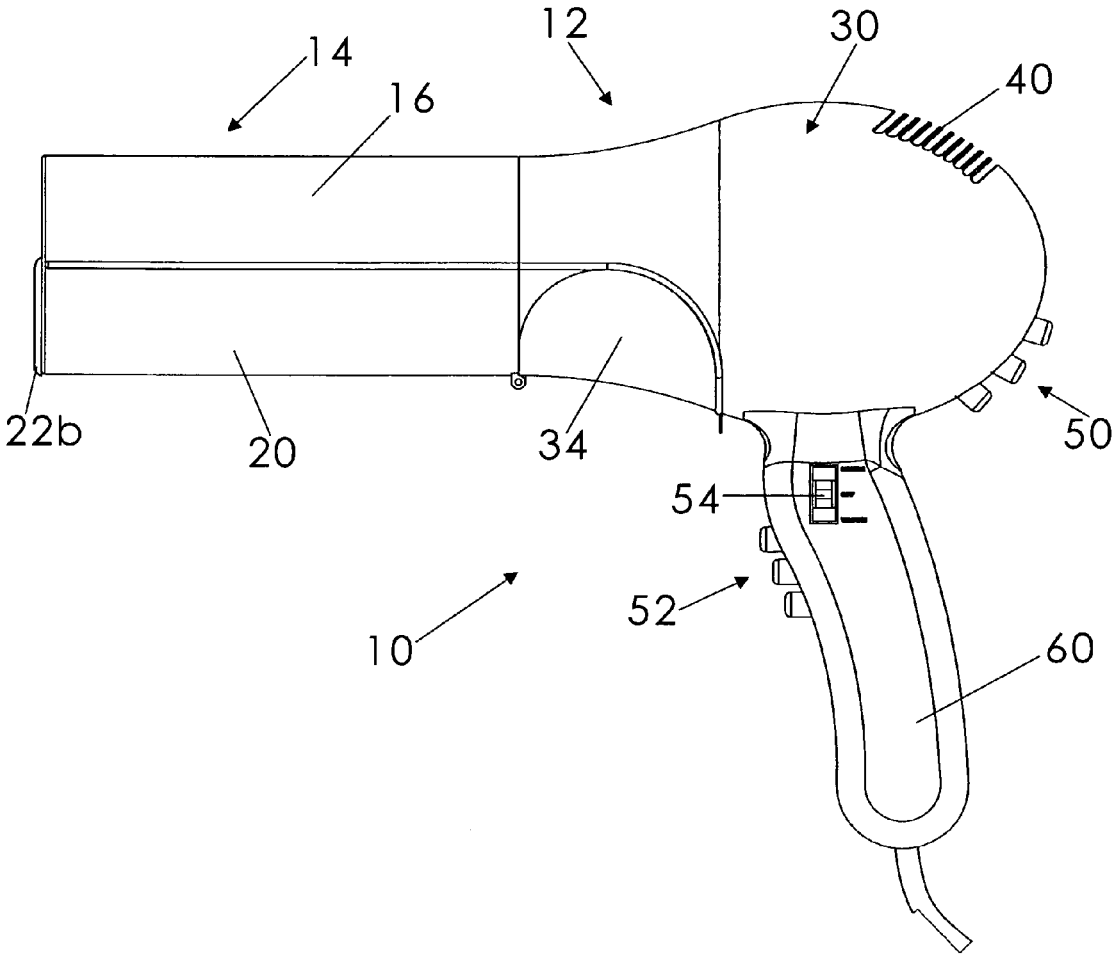
FIG. 3 is a side view of the device as in FIG. 1*a* with a collection chamber door in a closed configuration.
Figure 5:
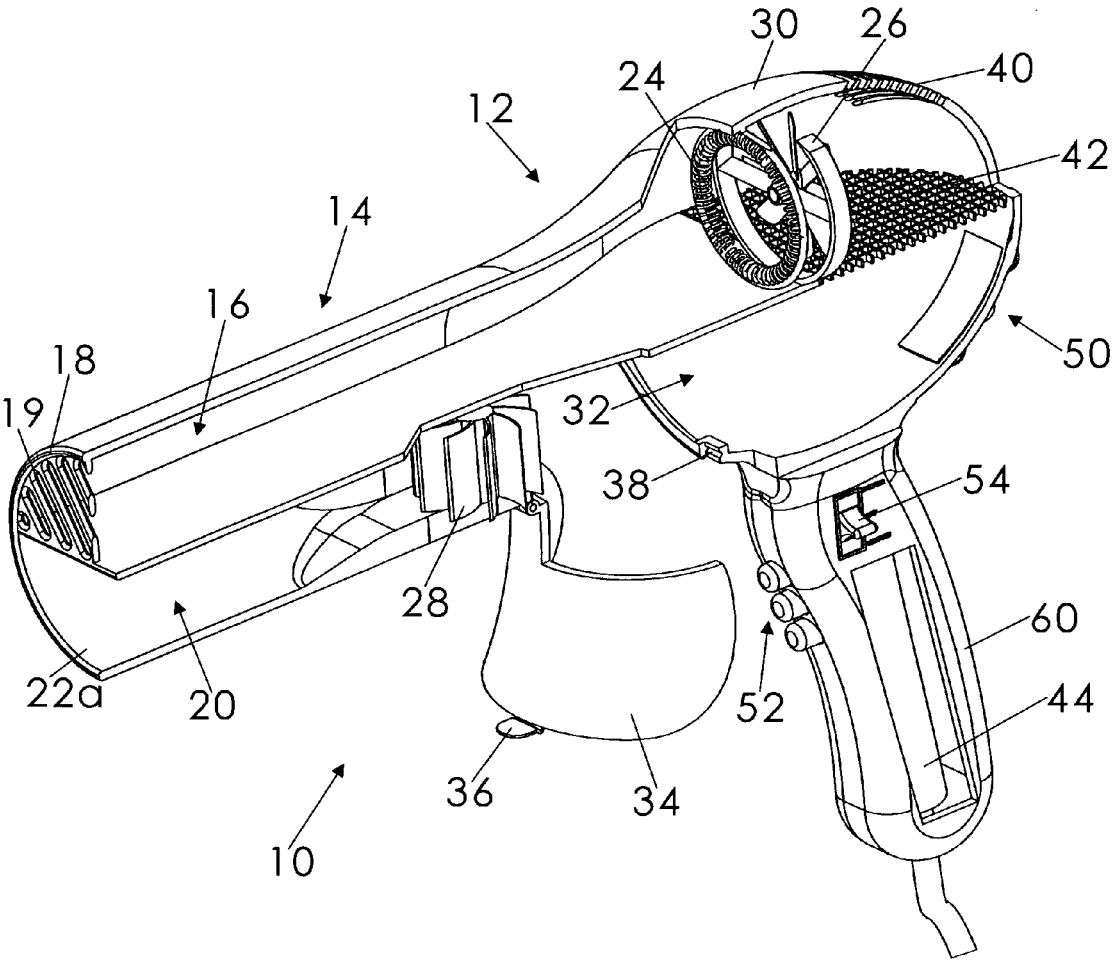
FIG. 5 is a fragmentary view of the device as in FIG. 1 with a portion of the housing wall being removed for clarity.
Figure 6:
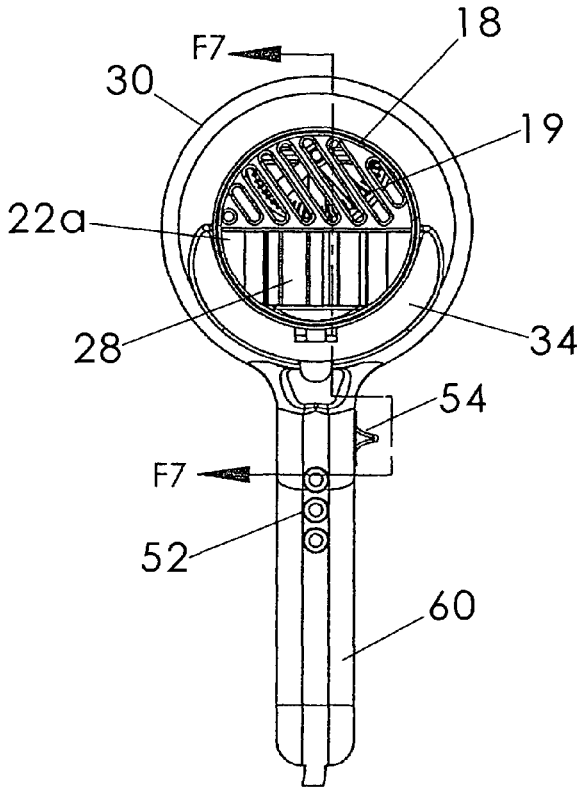
FIG. 6 is a front view of the device as in FIG. 1*a*.
Figure 7:
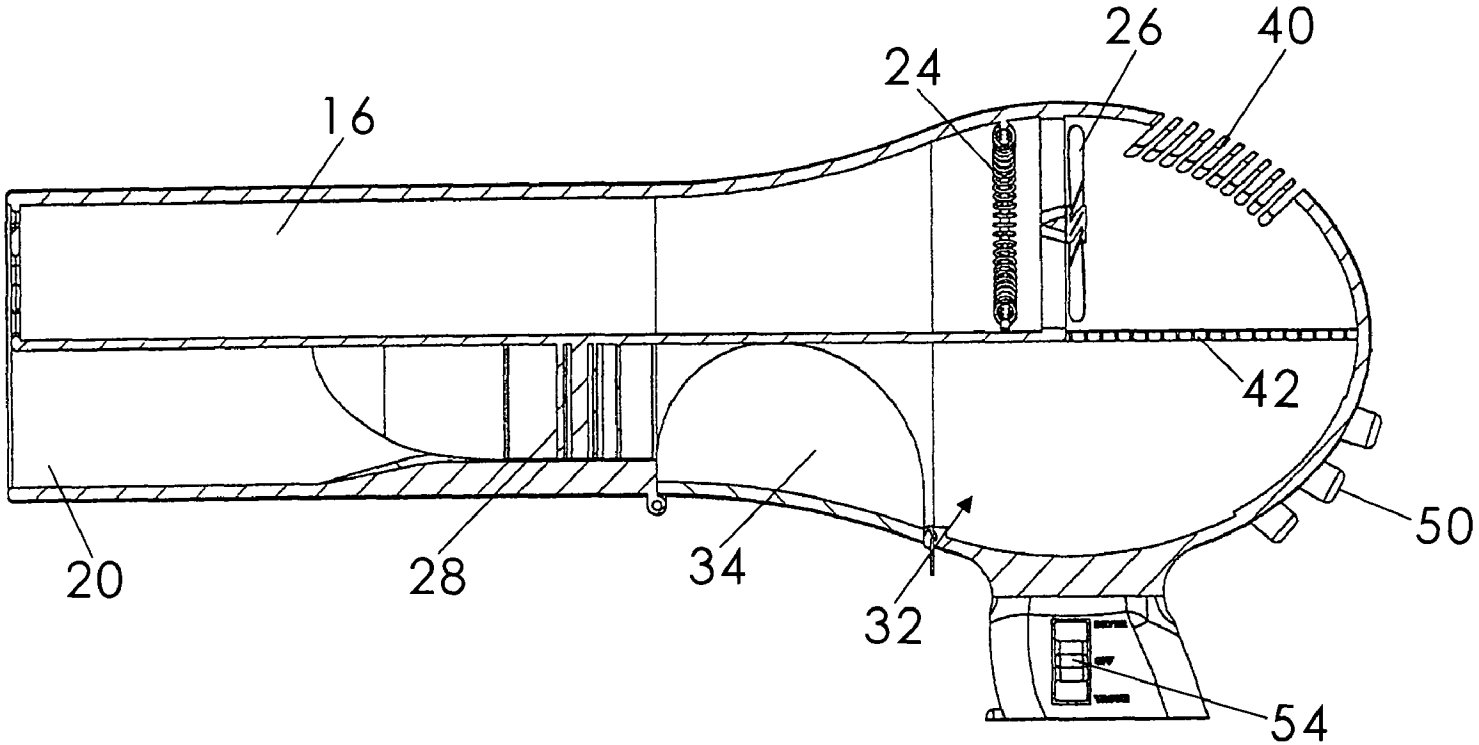
FIG. 7 is a sectional view taken along line F7-F7 of FIG. 6.

The nozzle 14 includes a first channel 16 extending from body portion 30 to a distal end defining an outlet port 18 (FIG. 5). The nozzle 14 also includes a second channel 20 extending generally from the body portion 30 to a distal end defining an inlet port 22. The inlet 22 and outlet 18 ports are adjacent one another and, more particularly, the outlet port 18 is positioned atop the inlet port 22*a*. Accordingly, the first channel 16 is positioned atop the second channel 20. The hollow first channel 16 is in communication with the hollow body portion 30 although the hollow second channel 20 is not in communication with the hollow interior area of the body portion 30. An inlet port insert 22*b* may be included so as to plug the second channel when not in use (FIGS. 1*a* and 2*a*).

A heating coil 24 is mounted within the hollow interior of the body portion 30 of the housing 12. The heating coil 24 is able to heat ambient air within the body portion 30 when it is electrically energized. A dryer fan 26 is mounted in the interior area of the body portion 30 and positioned rearwardly adjacent the heating coil 24. The dryer fan 26 includes blades configured to blow the heated air through the first channel 16 and out the outlet port 18 when electrically energized. The outlet port 18 may include a grating or grill 19 so as to prevent objects from being inadvertently inserted into the first channel 16 as this may result in contact with the heating coil 24.

Further, the hair dryer and vacuum device 10 includes a vacuum fan 28 mounted within the second channel 20 of the nozzle 14 (FIG. 5). The vacuum fan 28 may include blades configured to draw air into the second channel 20 through the inlet port 22 when electrically energized. Accordingly, this structure is operable to selectively suction fallen air into the second channel 20.

Figure 4A:
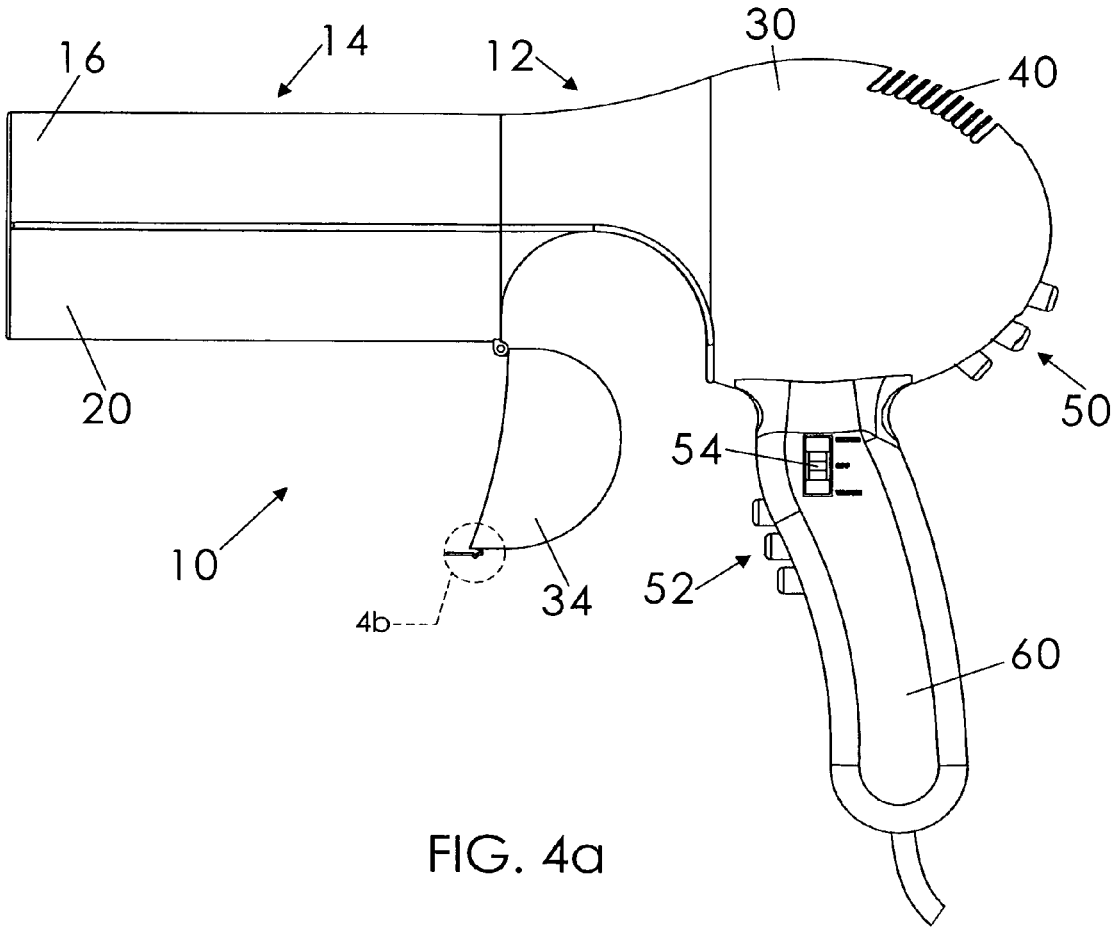
FIG. 4*a* is a side view of the device as in FIG. 3 with the collection chamber door in an open configuration.
Figure 4B:
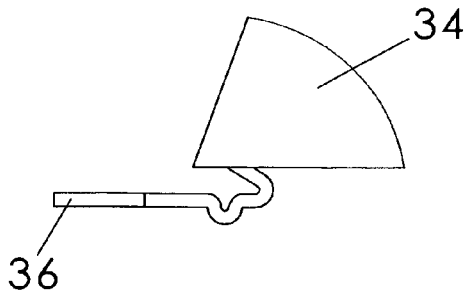
FIG. 4*b* is an isolated view on an enlarged scale taken from a portion of FIG. 4*a;*

The body portion 30 of the housing 12 defines a collection chamber 32 separate and not in communication with the interior of the body portion (FIG. 5). The collection chamber 32, however, is in communication with the second channel 20. A door 34 is operatively coupled to an underside of the housing 12 and, more particularly, to the second channel 20, that is movable between an open configuration providing access to the collection chamber (FIGS. 2*a*, 4*a*, and 5) and a closed configuration (FIGS. 3 and 7) enclosing the collection chamber 32. The door 34 includes a fastener 36 mounted or integrally formed along a free edge thereof (FIG. 2*a*). The body portion 30 defines a groove 38 having a configuration that is complementary to that of the fastener 36 (FIG. 2*b*) for selectively receiving the fastener and securing the door 34 in the closed configuration (FIG. 3) and that enables a user to release the door 34 to its open configuration (FIG. 4*a*) by manipulating the fastener 36 with his fingers. The fastener 36 may be constructed of a flexible plastic material or even spring steel such that it is flexible for easy manipulation (FIG. 4*b*).

Further, the body portion 30 of the housing 12 includes a vent opening 40 positioned in proximity to the dryer fan 26 such that ambient air may be drawn into the interior space to be heated when the heating coil 24 and dryer fan 26 are energized. A filter 42 may be situated between the vent opening 40 and the dryer fan 26 for collecting contaminants from the ambient air such that they are not blown through the first channel 16 by the fan.

The hair dryer and vacuum device 10 includes a power source for energizing the electrical components therein. The components may be powered by a battery or by traditional AC electricity. More particularly, a battery 44 may be positioned in the handle 60 and be electrically connected to the dryer fan 26, heating coil 24, and vacuum fan 28. Alternatively, or additionally, an electrical power cable and plug 46 may extend from the handle 60 and be electrically connected to the dryer fan 26, heating coil 24, and vacuum fan 28.

A first input 50 may be mounted to the housing 12 and electrically connected to the power source as well as to the heating coil 24 and dryer fan 26. The first input 50 may include high, medium, and low power setting buttons although other means for controlling the dryer fan 26 may be included, such as a dial or more/fewer controls. Preferably, the first input 50 is positioned on an exterior of the body portion 30 (FIG. 3) although being positioned on the handle 60 or other convenient location would also be suitable.

A second input 52 may be mounted to the housing 12 and electrically connected to the power source as well as to the vacuum fan 28. The second input 52 may include high, medium, and low power setting buttons although other means for controlling the vacuum fan 28 may be included, such as a dial or more/fewer controls. Preferably, the second input 52 is positioned on a front edge of the handle 60 (FIG. 1*a*) although being positioned on the body portion 30 or other convenient location would also be suitable.

Further, the device 10 includes a switch 54 electrically connected to the power source and to the first 50 and second 52 inputs and configured to selectively energize one of the inputs and, thus, energizing either the dryer fan 26 and heating coil 24 or the vacuum fan 28.

In use, a user may either connect the electric power plug 46 to an AC outlet or else rely on the battery 44. The user may toggle the switch 54 to select either the blow dryer fan 26 or the vacuum fan 28. Using the respective input, the user may either blow hot air through the first channel 16 of the nozzle so as to dry wet hair or suction cut or fallen hair through the inlet port 22 of the second channel 20 such that it is collected in the collection chamber 32. As desired, the user may open the door 34 and empty collected hair from the collection chamber 32 into a waste receptacle.

It is understood that while certain forms of this invention have been illustrated and described, it is not limited thereto except insofar as such limitations are included in the following claims and allowable functional equivalents thereof.

I claim:

1. A hair dryer and vacuum device for selectively drying hair and vacuuming fallen hair, comprising:

a housing having a nozzle, a handle, and a body portion situated between said handle and said nozzle;

wherein said nozzle includes a first channel extending from said body portion to an outlet port and a second channel extending from said body portion to an inlet port;

a heating coil mounted in said body portion for heating air;

a dryer fan positioned adjacent to said heating coil that is configured to blow said heated air from said body portion through said first channel outlet port when energized;

a vacuum fan mounted in said second channel that is configured to draw air into said second channel through said second channel inlet port when energized;

a collection chamber situated between said vacuum fan and said body portion and in communication with said second channel such that fallen hair is collected therein.

2. The hair dryer and vacuum device as in claim 1, further comprising a door coupled to said body portion that is movable between open and closed configurations such for selectively emptying collected hair from said collection chamber.

3. The hair dryer and vacuum device as in claim 1, wherein said body portion defines a vent opening in communication with said body portion through which ambient air is drawn when said dryer fan is energized.

4. The hair dryer and vacuum device as in claim 3, further comprising a filter situated between said vent opening and said dryer fan such that contaminants are prevented from being blown through said first channel.

5. The hair dryer and vacuum device as in claim 2 wherein:

said door includes a fastener; and said body portion defines a groove having a configuration complementary to said fastener for selectively securing said door in said closed configuration.

6. The hair dryer and vacuum device as in claim 4, further comprising a grill member situated in said outlet port.

7. The hair dryer and vacuum device as in claim 1 further comprising a battery situated in said handle and electrically connected to said dryer fan, said heating coil, and said vacuum fan.

8. The hair dryer and vacuum device as in claim 1 further comprising an AC electric power plug electrically connected to said dryer fan, said heating coil, and said vacuum fan.

9. The hair dryer and vacuum device as in claim 1 further comprising a first input electrically connected to said dryer fan.

10. The hair dryer and vacuum device as in claim 9, further comprising a second input electrically connected to said vacuum fan.

11. The hair dryer and vacuum device as in claim 10, further comprising a switch electrically connected to said first and second inputs.

12. A hair dryer and vacuum device for selectively drying hair and vacuuming fallen hair, comprising:

a housing having a nozzle, a handle, and a body portion situated between said handle and said nozzle;

wherein said nozzle includes a first channel extending from said body portion to an outlet port and a second channel extending generally from said body portion to a distal end defining an inlet port;

wherein said first channel is in communication with a interior area defined by said body portion and second channel is not in communication with said interior area;

a heating coil mounted in said body portion for heating air;

a dryer fan positioned adjacent to said heating coil that is configured to blow said heated air from said body portion through said first channel outlet port when energized;

a vacuum fan mounted in said second channel that is configured to draw air into said second channel through said second channel inlet port when energized;

a collection chamber situated between said vacuum fan and said body portion and in communication with said second channel such that fallen hair is collected therein;

a power source electrically connected to said dryer fan and said vacuum fan;

a first input electrically connected to said dryer fan;

a second input electrically connected to said vacuum fan;

a switch electrically connected to said first and second inputs that selectively directs current from said power source to either said first or said second input.

13. The hair dryer and vacuum device as in claim 12 further comprising an insert configured to selectively cover said second channel inlet port.

* * * * *